US011905482B1

(12) United States Patent
Meshchaninov et al.

(10) Patent No.: US 11,905,482 B1
(45) Date of Patent: Feb. 20, 2024

(54) FUEL BRIQUETTE

(71) Applicants: Mikhail Aleksandrovich Meshchaninov, Zhukovskiy (RU); Dmitrii Yanovich Agasarov, Krasnodar (RU); Anton Viktorovich Sergeev, Krasnodar (RU)

(72) Inventors: Mikhail Aleksandrovich Meshchaninov, Zhukovskiy (RU); Dmitrii Yanovich Agasarov, Krasnodar (RU)

(73) Assignees: Mikhail Aleksandrovich Meschaninov, Zhukovskiy (RU); Dmitrii Yanovich Agasarov, Krasnodar (RU); Anton Viktorovich Sergeev, Krasnodar (RU)

( * ) Notice: Subject to any disclaimer, the term of this patent is extended or adjusted under 35 U.S.C. 154(b) by 0 days.

(21) Appl. No.: 18/377,445

(22) Filed: Oct. 6, 2023

Related U.S. Application Data

(63) Continuation of application No. PCT/RU2023/000252, filed on Aug. 17, 2023.

(30) Foreign Application Priority Data

Aug. 3, 2023 (RU) ..... RU2023120455

(51) Int. Cl.
*C10L 5/44* (2006.01)

(52) U.S. Cl.
CPC ..... *C10L 5/442* (2013.01); *C10L 2200/0469* (2013.01)

(58) Field of Classification Search
CPC ..... C10L 5/442; C10L 2200/0469
See application file for complete search history.

(56) References Cited

FOREIGN PATENT DOCUMENTS

| | | | |
|---|---|---|---|
| CN | 111218315 | * | 6/2020 |
| EP | 0385665 A2 | | 9/1990 |
| GB | 2448531 A | | 10/2008 |
| RU | 2 187 542 C1 | | 8/2002 |
| RU | 2 378 325 C1 | | 1/2010 |
| RU | 2 733 946 C1 | | 10/2020 |
| RU | 2 793 126 C1 | | 3/2023 |

* cited by examiner

*Primary Examiner* — Cephia D Toomer
(74) *Attorney, Agent, or Firm* — Bardmesser Law Group

(57) ABSTRACT

Fuel briquettes based on carbon-containing materials, such as fuel briquettes for household use for heating of living and housekeeping spaces, glass-covered and film-covered greenhouses, especially in those geographic regions where no natural fuels like firewood, coal or turf are available. The fuel briquettes may also be used in chimney fireplaces, portable stoves, boilers, grills and braziers, for heating of railway carriages and accommodation cabins for labor and military personnel. A new binder, namely, Sosnowsky's hogweed, is used, providing environmental improvement and termination of weed infestation of fertile soils due to expansion of Sosnowsky's hogweed. The technical effects are attained by a fuel briquette containing a premix of ground carbon-containing filler and a biomass of ground plants of Sosnowsky's hogweed (e.g., entire plants including leaves, stems, roots and umbels) used as a binder. The briquette is compressed to remove liquid content and then dried.

14 Claims, No Drawings

FUEL BRIQUETTE

BACKGROUND OF THE INVENTION

Field of the Invention

The invention relates to fuel briquettes based on carbon-containing materials, in particular, to fuel briquettes for household use for autonomous, environmentally safe and cost effective heating of living and housekeeping spaces, glass-covered and film-covered greenhouses, especially, in those geographic regions, where no natural fuels like firewood, coal or turf are available, for cooking with barbecue, grills and braziers. The fuel briquettes may also be used in chimney fireplaces, portable stoves, boilers (like Russian "samovars"). Additionally, the fuel briquettes may be used for heating of railway carriages and accommodation cabins for labor and military personnel.

Description of the Related Art

There is a known fuel briquette of patent RU237832 (published on Jan. 10, 2010) containing disintegrated charcoal with particle size of 0.05 to 5 millimeters, water and a binder selected from starch, carboxymethyl cellulose, sodium hydrated silicate and sapropel. These components have the following ratio, in % wt.: starch 4 to 8, or carboxymethyl cellulose 4 to 8, or sodium hydrated silicate 2 to 5, or sapropel 2 to 10; water less than 3; and the balance is disintegrated charcoal. Density of the fuel briquette is 500 to 900 kg/m$^3$.

The main drawbacks of conventional fuel briquettes are complexity of preparation of initial components and manufacturing process, high cost of the initial components, and necessity of transportation of the used binder(s) to the place of manufacturing.

SUMMARY OF THE INVENTION

The object of the invention is using a new binder never used in fuel briquettes before, but widely available in certain locations, namely, Sosnowsky's hogweed, thereby saving resources, improvement of the environmental and termination of weed infestation of fertile soils due to huge expansion of Sosnowsky's hogweed in the world.

The technical effects are attained by a fuel briquette containing a premix of ground carbon-containing filler and a biomass of ground plants of Sosnowsky's hogweed used as a binder. The fuel briquette is compressed, removing liquid content, and then dried.

Sosnowsky's hogweed (*Heracleum sosnowskyi Manden*) is a big herbaceous plant of the carrot family (Apiaceae). It was widely introduced in fields of European portion of the USSR and Eastern Europe as a forage crop in the middle of the 20th century. Owing to ability of self-sowing, it was actively spreading beyond the fields of cultivation in the end of the 20th century. All parts of the plant contain furocoumarins, which are substances sharply increasing sensitivity of skin to ultraviolet light upon their contact with skin. Damage by sap or pollen of the plant may occur not only upon direct contact thereof with bare skin, but also through cloth. The plant may easily be identified by its enormous size, often 3 to 5 meters high. Its leaves may be of 1 meter or more in width. They are divided and distinctly acuminated. Lower surfaces of the leaves are covered with soft hair. A rigid grooved hollow stem of green color with garnet to violet spots may have diameter of 10 centimeters or more. Footstalks are marked by seta of each spot, which bleeds when broken.

Sosnowsky's hogweed is considered a weed, as it dramatically invades significant territories in Russia, Kazakhstan and Western Europe. Governmental and public programs exist in Western Europe, which aim at its elimination with no utilization thereof.

Sosnowsky's hogweed is characterized by a high crop yield of up to 250 tons per hectare. Combination of three factors, namely, high crop yield, ability of binding components of fuel briquettes and near zero-cost to obtain it (as it shall be eliminated as a noxious weed) makes Sosnowsky's hogweed a unique plant for producing fuel briquettes.

It is to be understood that both the foregoing general description and the following detailed description are exemplary and explanatory and are intended to provide further explanation of the invention as claimed.

DETAILED DESCRIPTION OF EMBODIMENTS OF THE INVENTION

As one embodiment, the invention is implemented as a fuel briquette of cylindrical shape with height of 60 mm and diameter of 30 to 36 mm. The fuel briquette contains ground charcoal and a biomass of ground plants of Sosnowsky's hogweed used as a binder, and 0.5% wt. of aspen wood ash, mixed in advance and then compressed with removal of liquid content and afterwards dried in a vacuum chamber. The briquette keeps its shape during transportation and burns out in 4 hours with no flame.

The fuel briquette is produced by premixing ground charcoal with a biomass of ground plants of Sosnowsky's hogweed, compressing in a hydraulic press with removing liquid content and then drying in a vacuum chamber during 4 to 5 hours at temperature of 50° C., after which it is ready to use. The fuel briquette burns up from one of its base sides and provides flameless combustion for 4 hours.

Preferably, ground charcoal of 10 to 20 μm grading fraction is used as the carbon-containing filler.

Preferably, plants of Sosnowsky's hogweed, and optionally entire plants including leaves, stems, roots and umbels, are used in ground form with size of solid particles of 10 to 20 μm.

Preferably, wood ash is added to the mixture of the carbon-containing filler and the biomass.

Preferably, aspen wood ash is used as the wood ash.

Preferably, 2% wt. of the biomass of ground plants of Sosnowsky's hogweed is included into content of the fuel briquette.

Preferably, 0.5% wt. of aspen wood ash is included into content of the fuel briquette.

Preferably, the fuel briquette is compressed using a hydraulic press and a molding tool with a straight hole, the molding tool configured to remove liquid content.

Preferably, the fuel briquette has cylindrical shape with height of 60 mm and diameter of 30 to 36 mm.

Preferably, the fuel briquette is compressed using a hydraulic press providing pressure of 300 to 500 tons.

Preferably, the fuel briquette is dried in a vacuum chamber during 4 to 5 hours at temperature of 50° C.

Thus, the technical effect is obtained. Novelty and inventive step of the invention are assured by including Sosnowsky's hogweed into fuel briquettes as a binder. This resource is widely available in certain locations, but it was not used for this purpose before. This approach provides resource saving, environmental improvement and termination of weed infestation of fertile soils due to huge expansion of Sosnowsky's hogweed in the world.

Having thus described a preferred embodiment, it should be apparent to those skilled in the art that certain advantages of the described method and apparatus have been achieved.

It should also be appreciated that various modifications, adaptations, and alternative embodiments thereof may be made within the scope and spirit of the present invention. The invention is further defined by the following claims.

What is claimed is:

1. A fuel briquette comprising:

a ground carbon-containing filler mixed in advance with a binder, wherein ground charcoal of 10 to 20 μm grading fraction is used as the carbon-containing filler, wherein a biomass of ground plants of Sosnowsky's hogweed is used as the binder; and the briquette is compressed to remove liquid content and then dried.

2. The fuel briquette of claim 1, wherein 2% wt of the biomass is used in the fuel briquette.

3. The fuel briquette of claim 1, wherein a wood ash is added to the mixture of the carbon-containing filler and the biomass.

4. The fuel briquette of claim 3, wherein the wood ash is aspen wood ash.

5. The fuel briquette of claim 4, wherein 0.5% wt. of the aspen wood ash is used in the fuel briquette.

6. The fuel briquette of claim 1, wherein the plants are used in ground form, having solid particles of 10 to 20 μm in size.

7. The fuel briquette of claim 1, wherein the fuel briquette has cylindrical shape with height of 60 mm and diameter of 30 to 36 mm.

8. The fuel briquette of claim 1, wherein entire plants of the Sosnowsky's hogweed, including leaves, stems, roots and umbels, are used for grinding into the binder.

9. A fuel briquette comprising:

a ground carbon-containing filler mixed with a binder, wherein ground charcoal of 10 to 20 μm grading fraction is used as the carbon-containing filler, wherein a biomass of ground plants of Sosnowsky's hogweed is used as the binder, and wherein any liquid content of the briquette is removed after the mixing and the briquette is then dried.

10. The fuel briquette of claim 9, wherein entire plants of the Sosnowsky's hogweed, including leaves, stems, roots and umbels, are used for grinding into the binder.

11. A method of making a fuel briquette, comprising:

mixing a ground carbon-containing filler with a binder, wherein ground charcoal of 10 to 20 μm grading fraction is used as the carbon-containing filler;

wherein a biomass of ground plants of Sosnowsky's hogweed is used as the binder; and removing any liquid content of the briquette; and drying the briquette.

12. The method of claim 11, wherein the fuel briquette is dried in a vacuum chamber during 4 to 5 hours at temperature of 50° C.

13. The method of claim 11, wherein the fuel briquette is compressed using a hydraulic press and a molding tool with a straight hole, wherein the molding tool is configured to remove liquid content from the fuel briquette.

14. The method of claim 13, wherein the hydraulic press provides a pressure of 300 to 500 tons for compressing the fuel briquette.

* * * * *